US010767373B2

(12) United States Patent
Aquilani

(10) Patent No.: US 10,767,373 B2
(45) Date of Patent: Sep. 8, 2020

(54) LEVELING COATING STRUCTURE WITH QUICK INSTALLATION AND REMOVAL

(71) Applicant: I DECK S.R.L., Vetralla (IT)

(72) Inventor: Enrico Aquilani, Vetralla (IT)

(73) Assignee: I DECK S.R.L., Vetralla (IT)

( * ) Notice: Subject to any disclaimer, the term of this patent is extended or adjusted under 35 U.S.C. 154(b) by 0 days.

(21) Appl. No.: 16/337,062

(22) PCT Filed: Sep. 21, 2017

(86) PCT No.: PCT/IB2017/055716
§ 371 (c)(1),
(2) Date: Mar. 27, 2019

(87) PCT Pub. No.: WO2018/060815
PCT Pub. Date: Apr. 5, 2018

(65) Prior Publication Data

US 2020/0032522 A1 Jan. 30, 2020

(30) Foreign Application Priority Data

Sep. 28, 2016 (IT) ..... 102016000097094

(51) Int. Cl.
*E04F 13/08* (2006.01)

(52) U.S. Cl.
CPC ..... *E04F 13/0826* (2013.01); *E04F 13/0807* (2013.01)

(58) Field of Classification Search
CPC ..... E04F 13/0826; E04F 13/0807
See application file for complete search history.

(56) References Cited

U.S. PATENT DOCUMENTS 4,453,364 A 6/1984 Ting
6,470,647 B2 * 10/2002 Hsueh ..... E04F 13/0807 52/235
D619,880 S * 7/2010 MacDonald ..... E04F 13/0826 D8/354

FOREIGN PATENT DOCUMENTS

DE 20 2007 002282 U1 6/2008
DE 202012104056 U1 * 1/2014 ..... E04F 15/105
FR 2843414 A1 2/2004
GB 2070100 A 9/1981
WO 2008/000747 A1 1/2008

(Continued)

OTHER PUBLICATIONS

International Search Report and Written Opinion, dated Dec. 20, 2017, from corresponding PCT application No. PCT/IB2017/055716.

*Primary Examiner* — Babajide A Demuren
(74) *Attorney, Agent, or Firm* — Nixon & Vanderyhe

(57) ABSTRACT

A leveling coating structure with quick installation and removal includes a plurality of parallel sections; a multiplicity of clips having a head with a stem and a bushing with inserts, the stem being inserted in a through hole of the section and rotatably retained by the inserts of the bushing which is in abutment with the bottom of the base frame opposite to the head of the clip; a succession of slats having opposite lateral grooves which the head of the clip engages. Each section is made of light alloy with a C-shaped cross-section having a core for supporting the slats and wings for the insertion of the bushings between them. Each clip is retained by the section with the head in abutment with the core for supporting the slats and the bushing in abutment with the free ends of the wings.

11 Claims, 12 Drawing Sheets

(56) References Cited

FOREIGN PATENT DOCUMENTS

| | | | | | |
|---|---|---|---|---|---|
| WO | 2008/093383 | A1 | | 8/2008 | |
| WO | WO-2015159136 | A1 | * | 10/2015 | ..... E04F 15/02405 |

* cited by examiner

LEVELING COATING STRUCTURE WITH QUICK INSTALLATION AND REMOVAL

PRIOR ART

Patent Application No. PCT/IT2008/000065 describes a mounting and dismounting system for wooden slats on a base frame. The removable connection between the wooden slats and the base frame is made by clamps or T-clips. Each T-clip has a rotating stem in a bushing with inserts, the bushing passing through the base frame and ending with a radial extension to abut the bottom of the base frame. The T-clip also has a head to engage a groove formed on the sides of the wooden slat. The head of the T-clip has a butterfly-shaped recess in which a T-shaped key can be inserted to rotate the head of the T-clip in one or another direction and create an engagement or disengagement between the wooden slat and the base frame.

FIELD OF THE INVENTION

The present invention relates to a leveling structure with quick installation and removal.

In the above-mentioned PCT application, the base frame is made of strips of wood, in which shaped holes are formed so as to receive the bushing mentioned above.

This should create a stable connection between the strips of wood and the wooden slats, which are arranged orthogonal to the parallel wooden slats and form a covering.

However, it has been seen that a coating structure according to the patent application mentioned above has some drawbacks. In the strips of wood, precise seats must be formed to accommodate the bushings of the T-clips. Strips of wood are not stable over time, being subject to deformations due to thermal variations and humidity. The T-clips of the coating structure do not block in a reliable way the wooden slats to the strips of wood of the base frame. Moreover, the coating structure described in the above-mentioned PCT application cannot be leveled with respect to a base surface upon which it is applied. This drawback is particularly relevant when the coating structure is applied to an irregular base surface.

SUMMARY OF THE INVENTION

The present invention aims to overcome the above-mentioned drawbacks.

In particular, an object of the invention is to provide, for a coating structure of the aforementioned type, a base frame that is stable over time and convenient to apply.

Another object of the invention is to provide a reliable connection between the base frame and the covering slats.

A further object of the invention is to create a readily releasable engagement between connecting elements and slats in a surface coating structure in order to quickly install and remove the slats.

Yet another object of the invention is to make leveling the coating structure with respect to the base surface to which it is applied.

These and other objects and advantages are achieved by a leveling, fast-mounting and quick-release coating structure as defined in the main claim and the dependent claims thereof attached to this description.

BRIEF DESCRIPTION OF THE DRAWINGS

Embodiments of the invention are set forth in the following detailed description, by referring to the accompanying drawings in which.

DESCRIPTION OF EMBODIMENTS OF THE INVENTION

Figure 1:
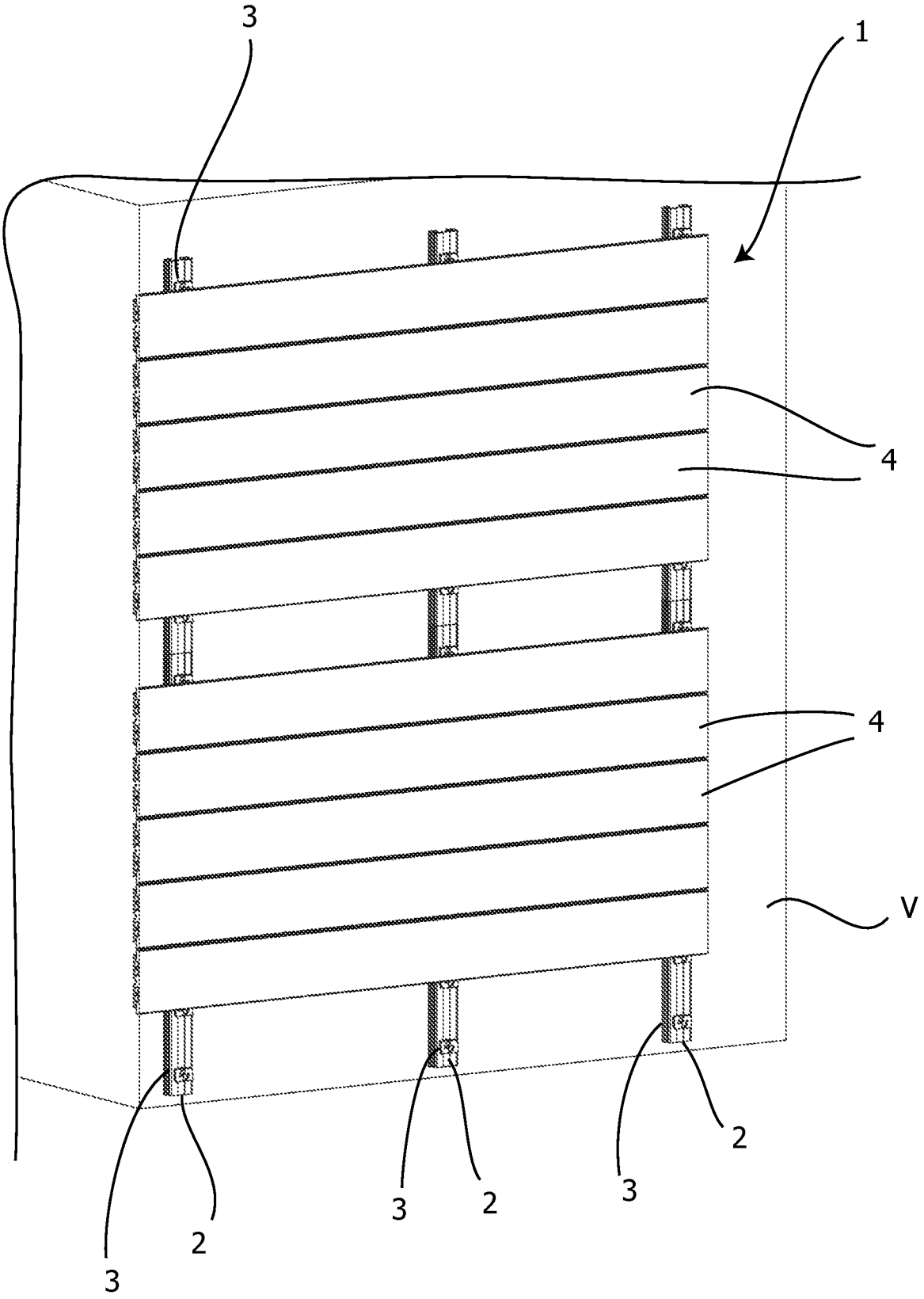
FIG. 1 is a perspective view of a coating structure according to the present invention when applied to a vertical wall.
Figure 2:
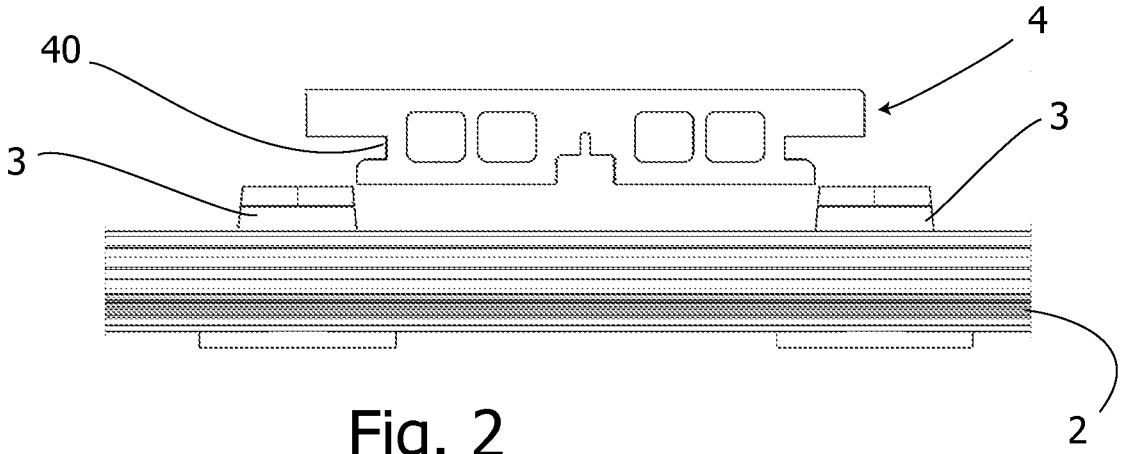
FIGS. 2 and 3 are partial end views of the coating structure shown in FIG. 1 in two successive positions in mounting a slat to the base frame.
Figure 3:
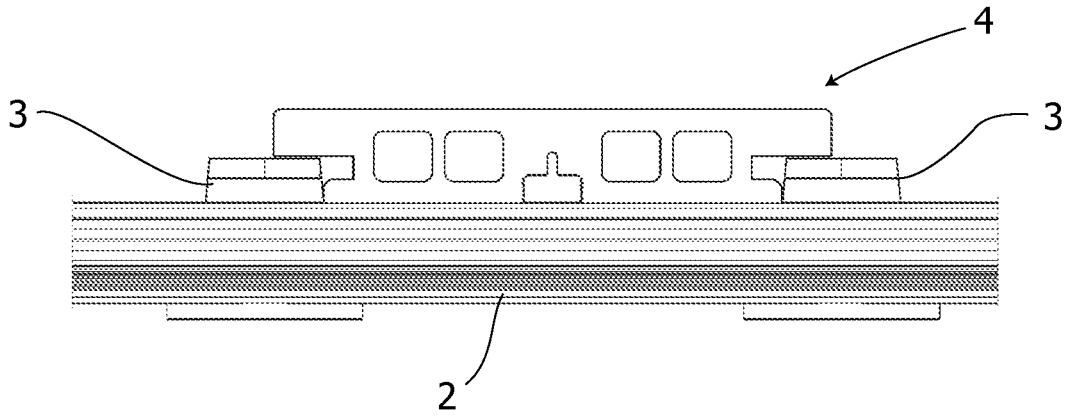

Reference should be made to FIGS. 1 to 3, which are a perspective view of a coating structure 1 according to the present invention and partial end views thereof, respectively, with two successive positions in mounting a slat to the base frame.

The coating structure 1 is shown applied to a vertical wall V, but, although not shown, it is also applicable on horizontal surfaces.

In general, the coating structure 1 has a plurality of parallel sections 2, a plurality of clamps or clips 3, and a succession of slats 4.

Figure 4:
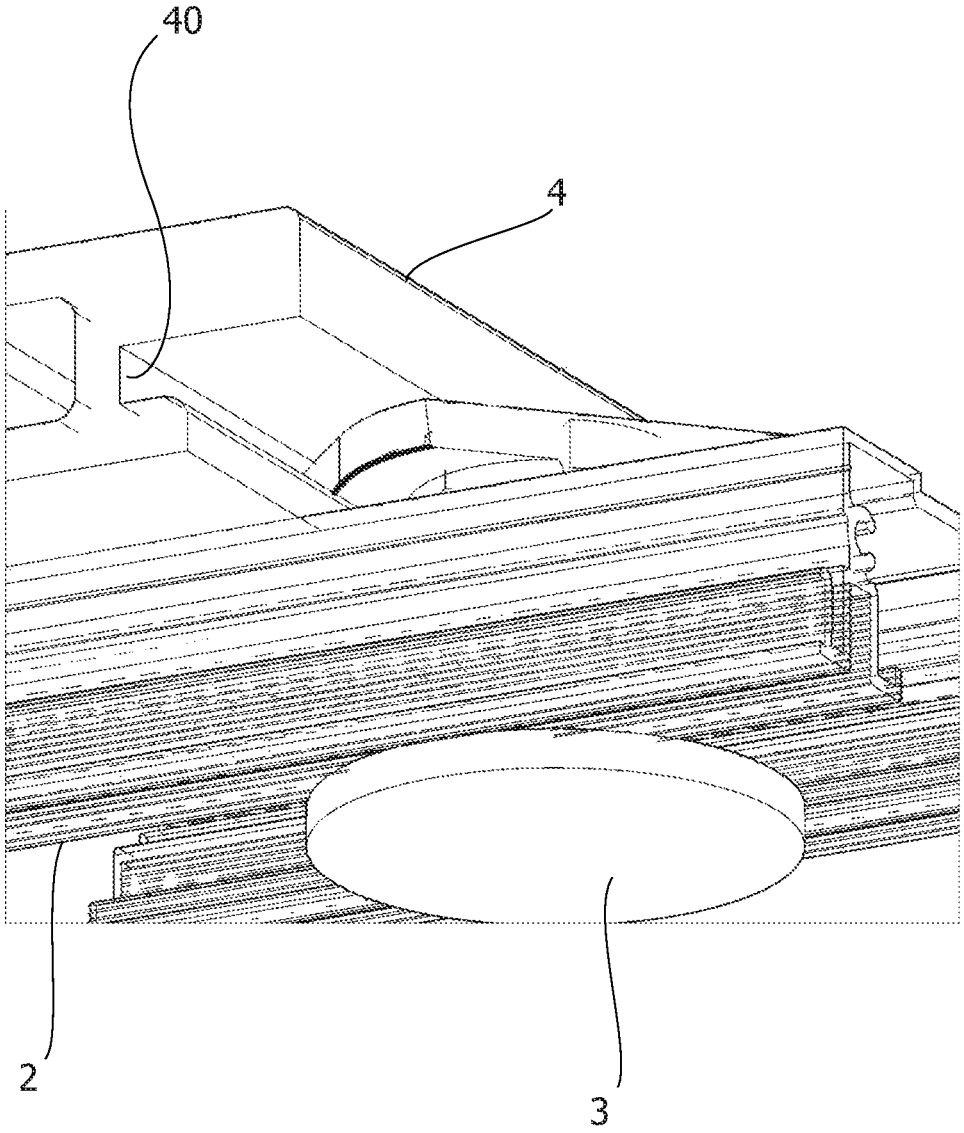
FIG. 4 is an enlarged scale view of an end portion of the coating structure in FIG. 3.

As in the prior art, the plurality of parallel sections 2, forming a base frame on the base surface of the support plane represented by the vertical wall V, is provided with a plurality of through holes for receiving the corresponding plurality of clips 3, which is capable of blocking the succession of slats 4. This is shown in FIG. 4, which is an enlarged scale view of an end portion of the coating structure 1. A clip head 25, described in greater detail below, is inserted in a lateral groove 40 of a slat 4 of the succession of slats. The slats 4 are known and will not be further described.

Figure 5:
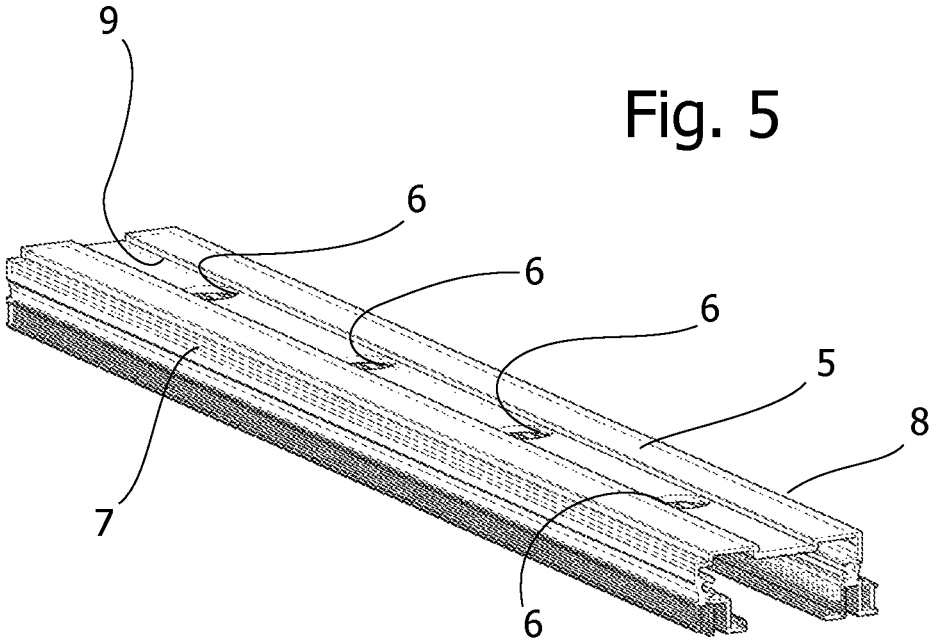
FIG. 5 is a perspective view of a base frame section of the coating structure according to the present invention.
Figure 6:
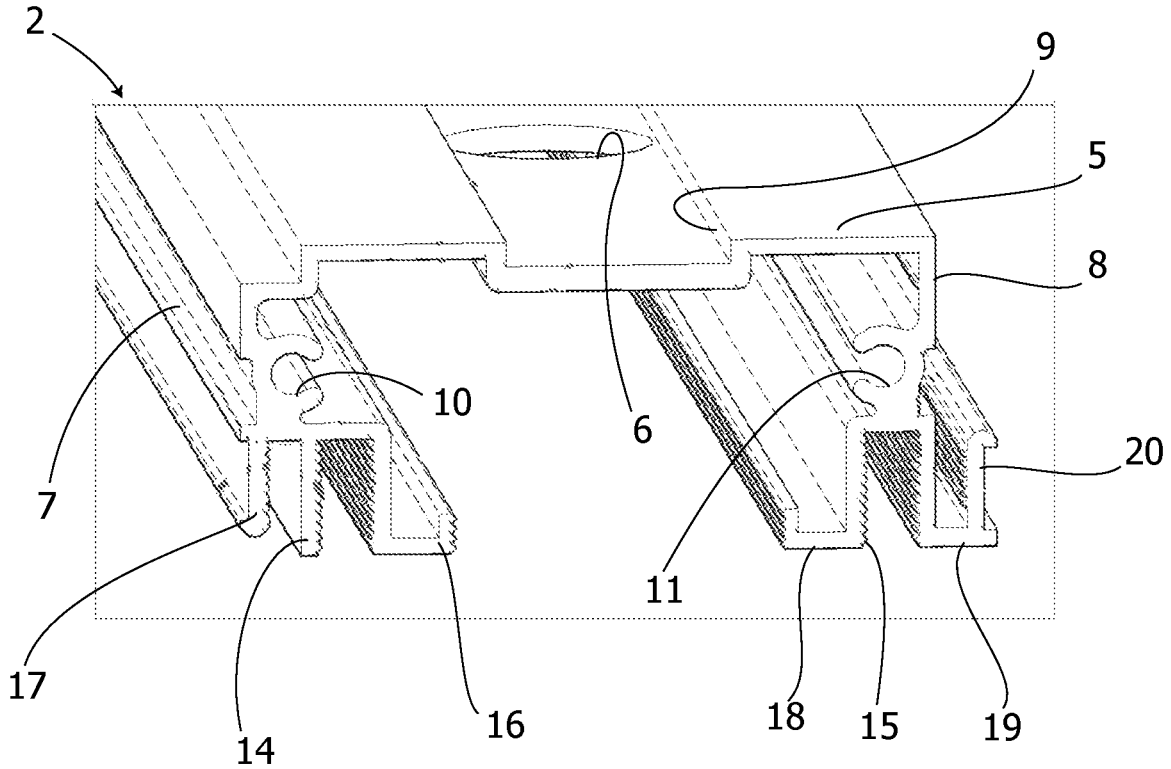
FIG. 6 is a perspective view of an end of the section in FIG. 5 in an enlarged scale.

According to the invention, the section 2, as shown in FIG. 4, but also in FIGS. 5 and 6, which are its perspective views, is made of light alloy with a C cross-section.

The C cross-section of the section 2 has a core 5 supporting the slats, core 5 in which a plurality of through holes 6 and wings 7, 8 are formed, whose free ends are the bottom of the section.

The core 5 of the section 2 has a central depression 9 in which the through holes 6 are formed at regular distances.

Figure 10:
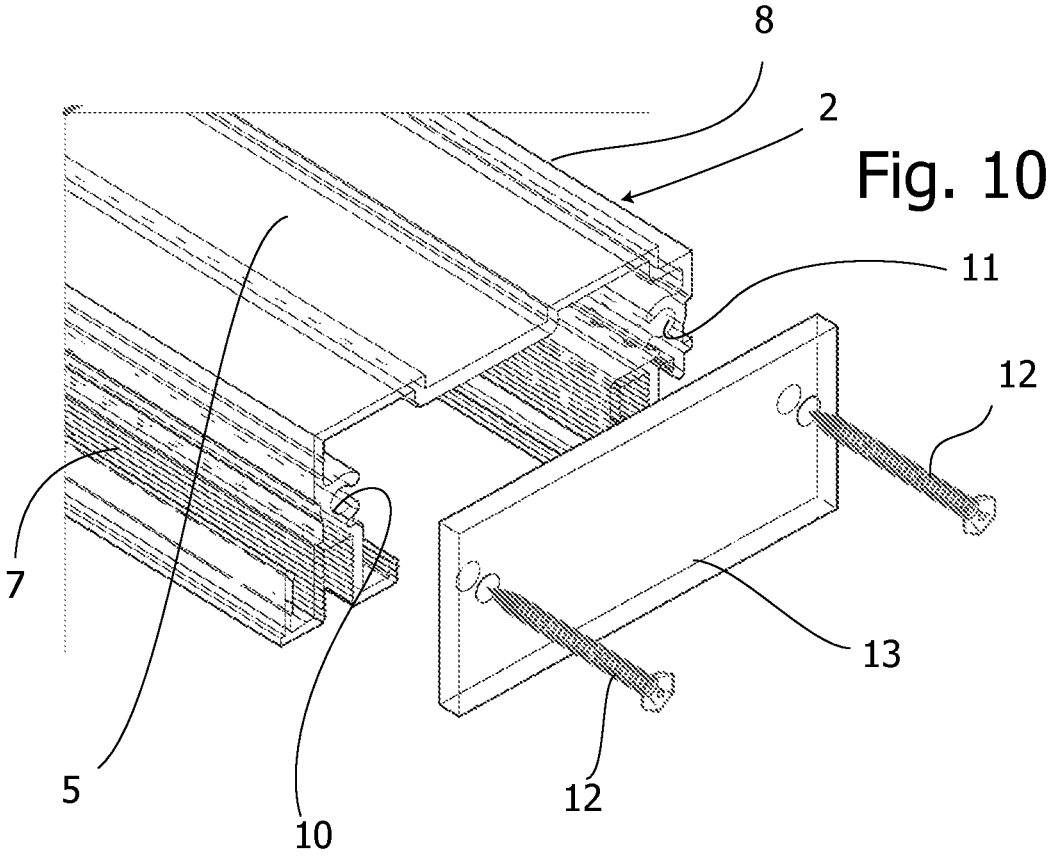
FIG. 10 is a perspective end view of a base frame section to which a plug is applied.

The wings 7, 8 of the section 2 have C-shaped facing recesses 10, 11. The recesses 10, 11 are intended for inserting screws 12 for applying an end cap 13 to the section 2. This is shown in FIG. 10 which is a perspective view of the end of a base frame section 2.

Returning to FIG. 6, the wings 7, 8 terminate at the bottom with inverted U-shaped supporting feet 14, 15. The supporting foot 14 extends with an orthogonal portion 16 towards the inside of the section 2, and with an L-shaped angular portion 17 to the outside of the section 2. The other supporting foot 15 extends with a first orthogonal portion 18 towards the inside of the section 2, and with a second orthogonal portion 19 towards the outside. The second orthogonal portion 19 continues in a third orthogonal portion 20 upwards to allow a side-by-side joining of a section 2 with another.

Figure 7:
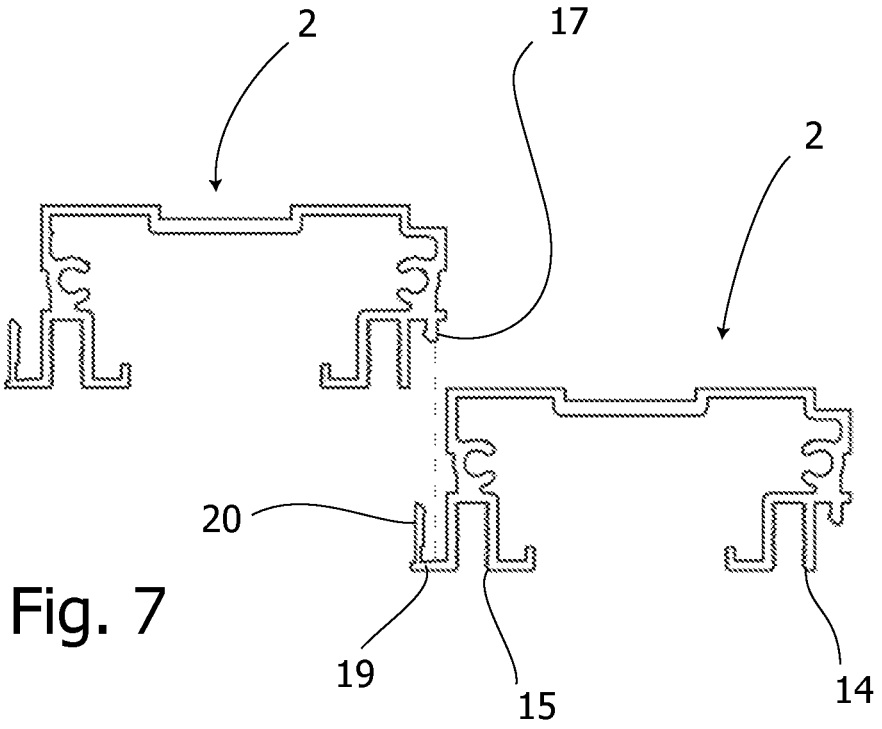
FIG. 7 is an end view of two sections as those in FIG. 6 previously to be flanked.
Figure 8:
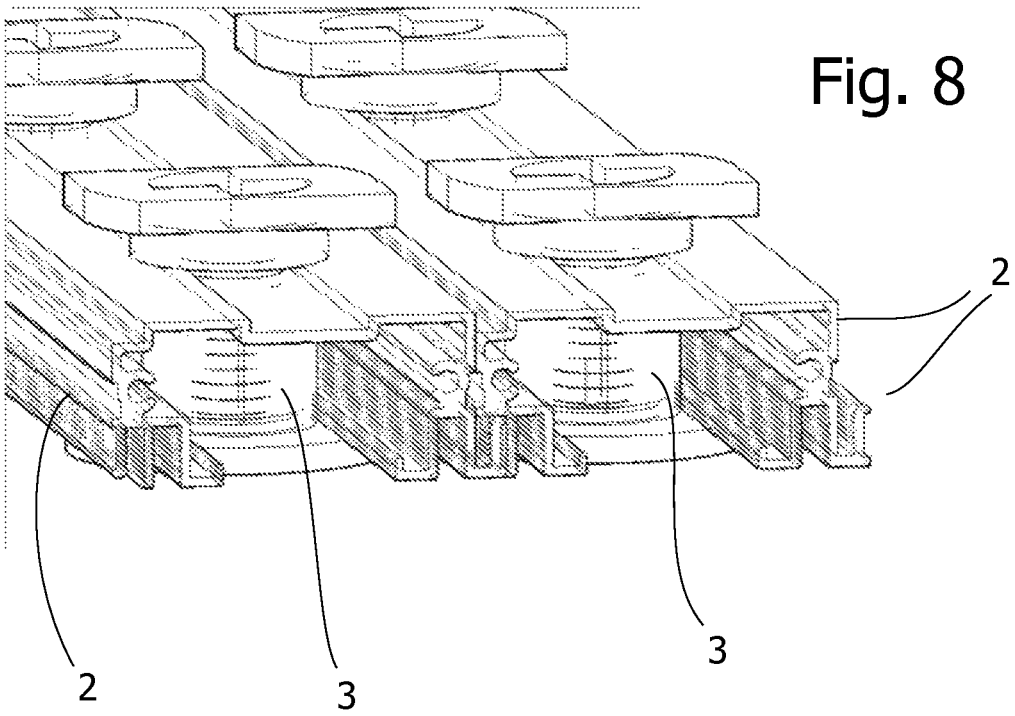
FIG. 8 is a perspective view of end of two sections such as those in FIG. 7, side-by-side and complete with clips.

This is shown in FIGS. 7 and 8, which are an end view of two sections 2 before being flanked and an end perspective view of two sections respectively, as shown in FIG. 7, being side-by-side and complete with clip 3. Indeed, in the views of FIGS. 7 and 8, the L-shaped angular portion 17 has a lower extension downwards than shown in FIG. 6. However, the function is the same: to allow the insertion of the L-shaped angular portion 17 of the first section 2 in the groove formed in the second section 2 by the supporting foot 15, by the second orthogonal 19 outwardly and by the third orthogonal portion 20 upwards.

This side-by-side jointing of two sections 2 is useful when only one slat or, mostly, when a succession of slats 4 terminates with its end over a base frame section 2. In this case, in fact, only one section 2 would not be enough to cantilever support two consecutive slats.

Figure 9:
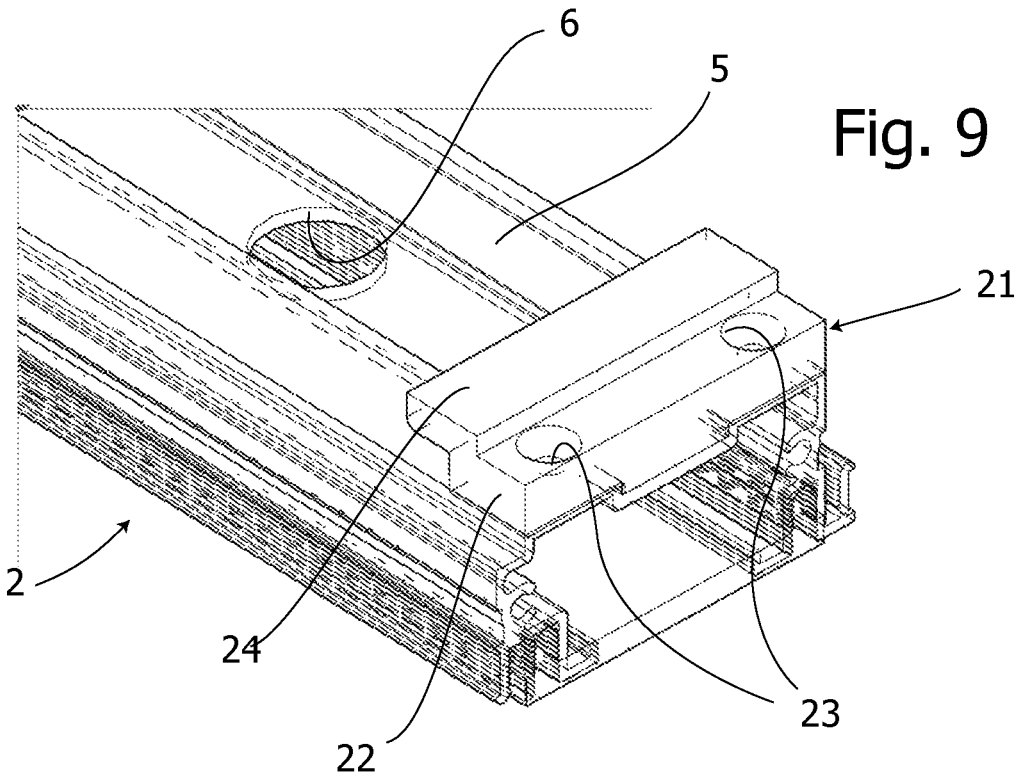
FIG. 9 is a perspective end view of a base frame section having a stop element of a slat.

Reference is made to FIG. 9 which is an end perspective view of a base frame section 2 to which a useful accessory for the coating structure according to the present invention is applied. The accessory in question is an abutting element 21 with a Z-shaped profile having a lower portion 22 provided with a pair of holes 23 for fixing the abutting element 21 on the outer surface of the core 5 of the base frame section 2 by screws (not shown). Further, the abutting element 21 has an upper portion 24 adapted to fit into the lateral groove 40 of a slat 4, as shown in FIGS. 2 and 4. Thus, an end slat of the coating is properly retained.

As mentioned above, a plurality of clamps or, more simply, clips 3 connects the base frame sections 2 of the coating structure with the succession of slats 4.

Figure 11:
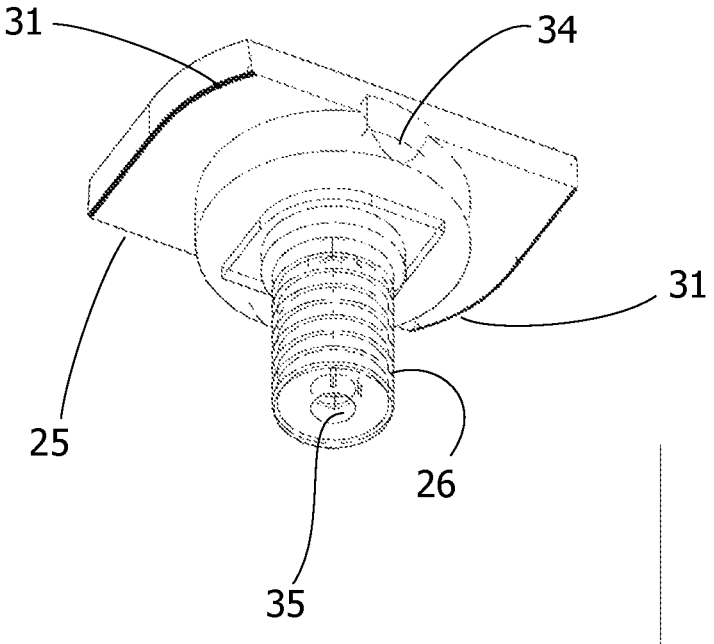
FIG. 11 is a perspective view of a clip head with a stem according to a first variant.
Figure 12:
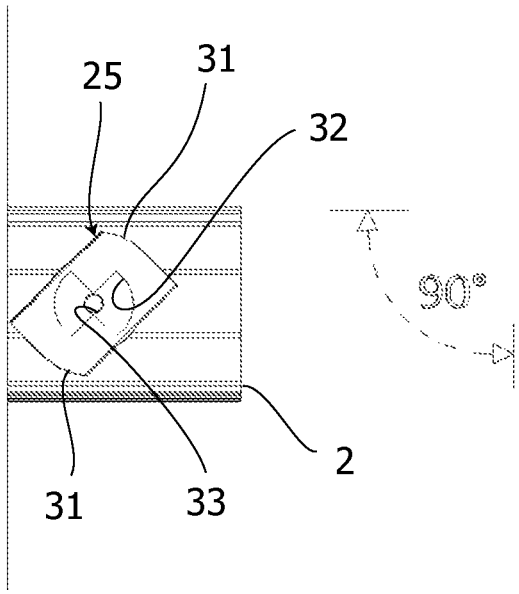
FIG. 12 is a top plan view of the clip head in FIG. 11 with the addition of the indication of its rotation angle.
Figure 13:
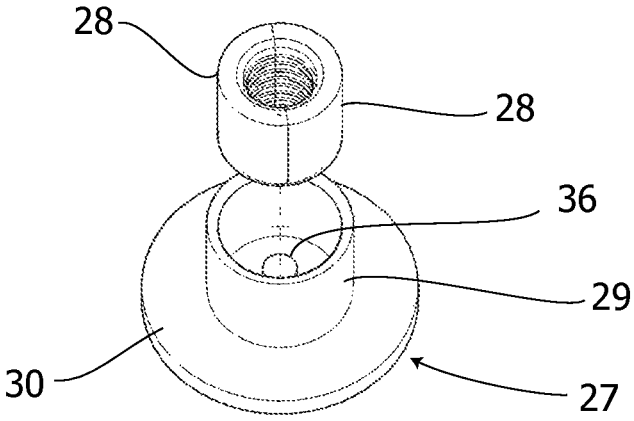
FIG. 13 is an exploded perspective view of a first clip bushing variant for the coating structure according to the present invention.

Reference is made now to FIGS. 11 to 13, which are a perspective view of a head with stem of a clip, a top perspective view of the clip head with indication of its angle of rotation, and an exploded perspective view of a first variant of the clip bushing.

Each clip 3 has a head 25 with stem 26 and a bushing 27 with inserts 28. The stem 26, which is orthogonal to the head 25, is inserted into the through hole 6 (FIG. 5) of the base frame section 2. The stem 26 is held rotatably by the inserts 28 within the cylindrical wall 29 of the bushing 27. Below, the inserts 28 are slightly beveled to facilitate their insertion into the cylindrical wall 29. They are flared above in order to facilitate the connection with the stem 26.

The bushing 27 abuts, by its circular plate 30 extending beyond the cylindrical wall 29, with the inverted U-shaped supporting feet 14, 15 and corresponding orthogonal portion 16, first orthogonal portion 18 and second orthogonal portion 19, opposite to the head 25 of the clip 3.

The rotatable engagement between the stem 26 and the inserts 28 is obtained in a known way by means of corresponding ridges and grooves, not marked by reference numerals, in the stem 26 and in the inserts 28. The head 25 of the clip 3 is prismatic with a rectangular plant that is beveled in opposite vertices 31 to allow a rotation of the head 25 of the clip 3 of only 90° in the engagement with the lateral groove 40 of the slat 4 as shown in FIG. 4. The indication of this constraint to the rotation of the head 25 with its stem 26 is shown in FIG. 12, wherein the head 25 is shown as rotated of about 45°, i.e. intermediate between the engagement position with the slat 4 for its locking and a free position.

The rotation of the head 25 is obtained, as known, by the engagement of a T-key (not shown) with a butterfly-shaped recess 32 formed in the top of the head 25.

According to the invention, centrally made in the head 25 is a first hexagonal hole 33 for a hexagonal male key.

In addition, the clip head 25 is laterally provided with a projection 14 like a downward facing arrow tip to display the head position with respect to the lateral groove 40 of the slat 4.

Further, according to the invention, the stem 26 of the clip head 25 is provided with a central hole 35. As shown in FIG. 13, in the bushing 27, coaxially to the stem 26 of the head 25, a pin 36 is provided internally to the cylindrical wall 29 suitable to fit into the central hole 35 of the stem 26 of the head 25. The pin 36 inserted in the stem 26 has a retaining effect which makes the presence of the two inserts 28 not indispensable.

Figure 14:
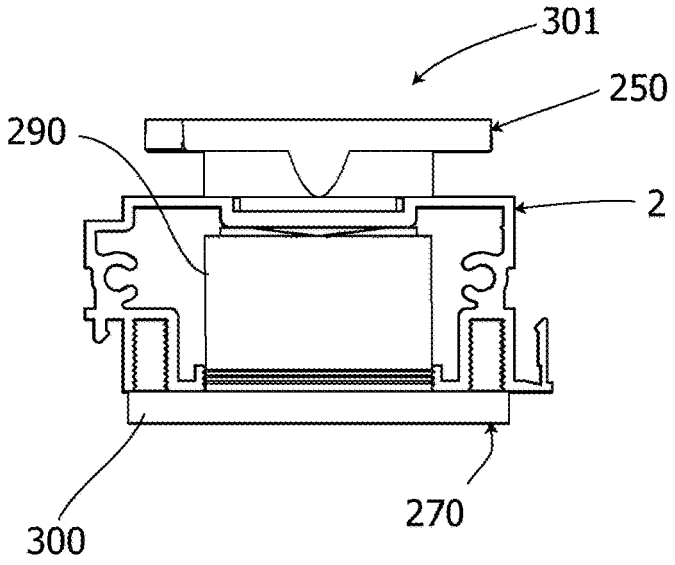
FIG. 14 is an end view of a base frame section and a second clip variant.
Figure 15:
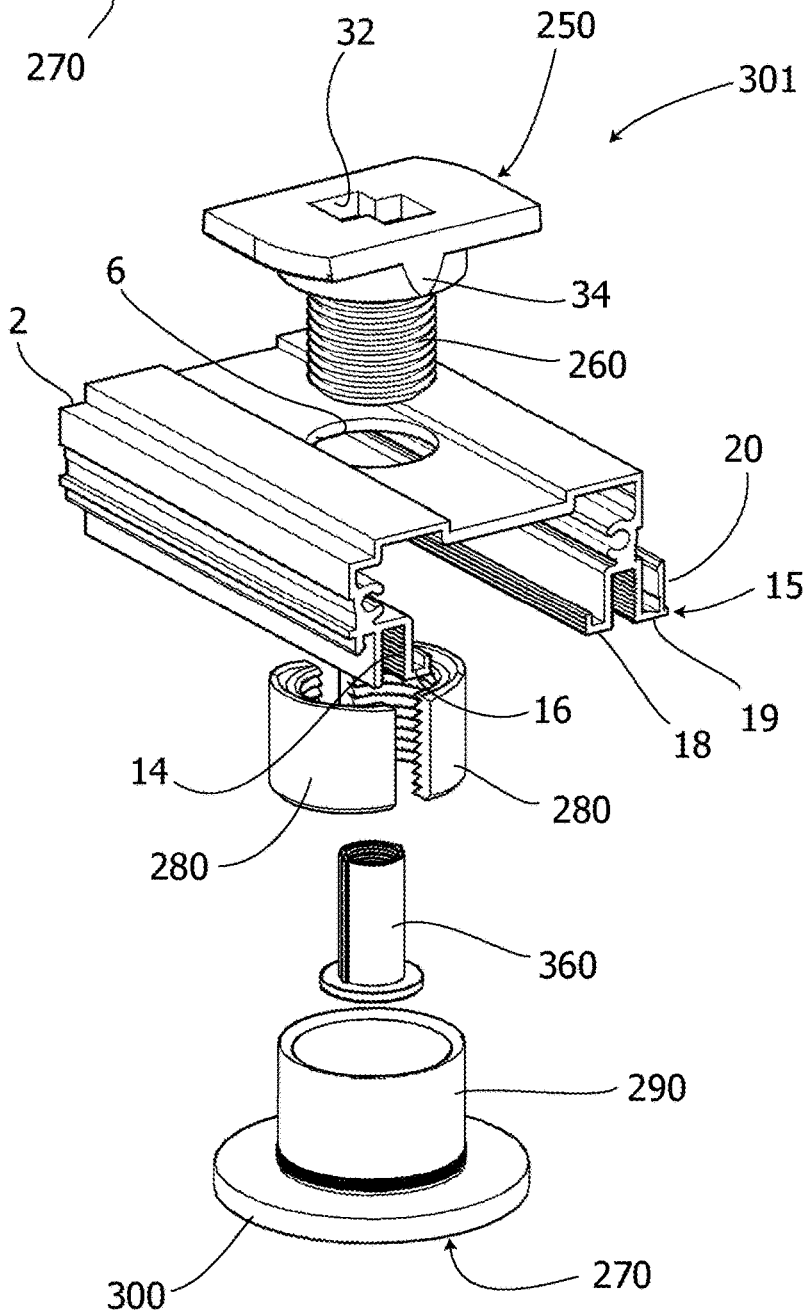
FIG. 15 is an exploded perspective view of the section and clip in FIG. 14.

Now, reference is made to FIGS. 14 and 15 which are a side view and an exploded perspective view of the clip in its second variant. As will be seen later, this second variant of the clip can be used, in combination with a threaded foot, to adjust the level of the coating structure relative to the base surface of its support plane.

Unlike the first variant shown in FIGS. 11 to 13, whose reference numerals are used for indicating similar components, in the second variant shown in FIGS. 14 and 15, the clip 301 has a head 250 with stem 260 and a bushing 270 with inserts 280. The stem 260 is inserted into the through hole 6 of the base frame section 2.

The stem 260 is held rotatably by the inserts 280 within the cylindrical wall 290 of the bushing 270. It is noted that the inserts 280 are slightly beveled at the bottom to facilitate their insertion into the cylindrical wall 290. They are flared above to facilitate connection with the stem 260.

The bushing 270 abuts, by its circular plate 300 extending beyond the cylindrical wall 290, with the inverted U-shaped supporting feet 14, 15 and corresponding orthogonal portion 16, first orthogonal portion 18 and second orthogonal portion 19, opposite to the head 250 of the clip 301.

According to the second variant, an internally threaded sleeve 360 is provided inside the cylindrical wall 290 of the bushing 270. Although not shown in FIGS. 14 and 15, the circular plate 300 of bushing 270 is centrally perforated as shown in FIGS. 16 to 19, which are views and cross-sections of the section and of the clip complete with a leveling member 41 in a contracted position and with a first hexagonal male key for the rotation of the clip head, and respectively with a second hexagonal male key for the rotation of the leveling member 41. The leveling member 41 comprises a foot 37 and a corresponding threaded stem 38.

The circular plate 300 is provided with a hole 39 so that the threaded stem 38 of the leveling member 41 can pass through the bushing 270 and screw to the threaded sleeve 360 therein. The threaded stem 38 has a lowered hexagonal upper seat 42 to allow the insertion from the top of a hexagonal male key CH2, shown in FIG. 18.

Figure 16:
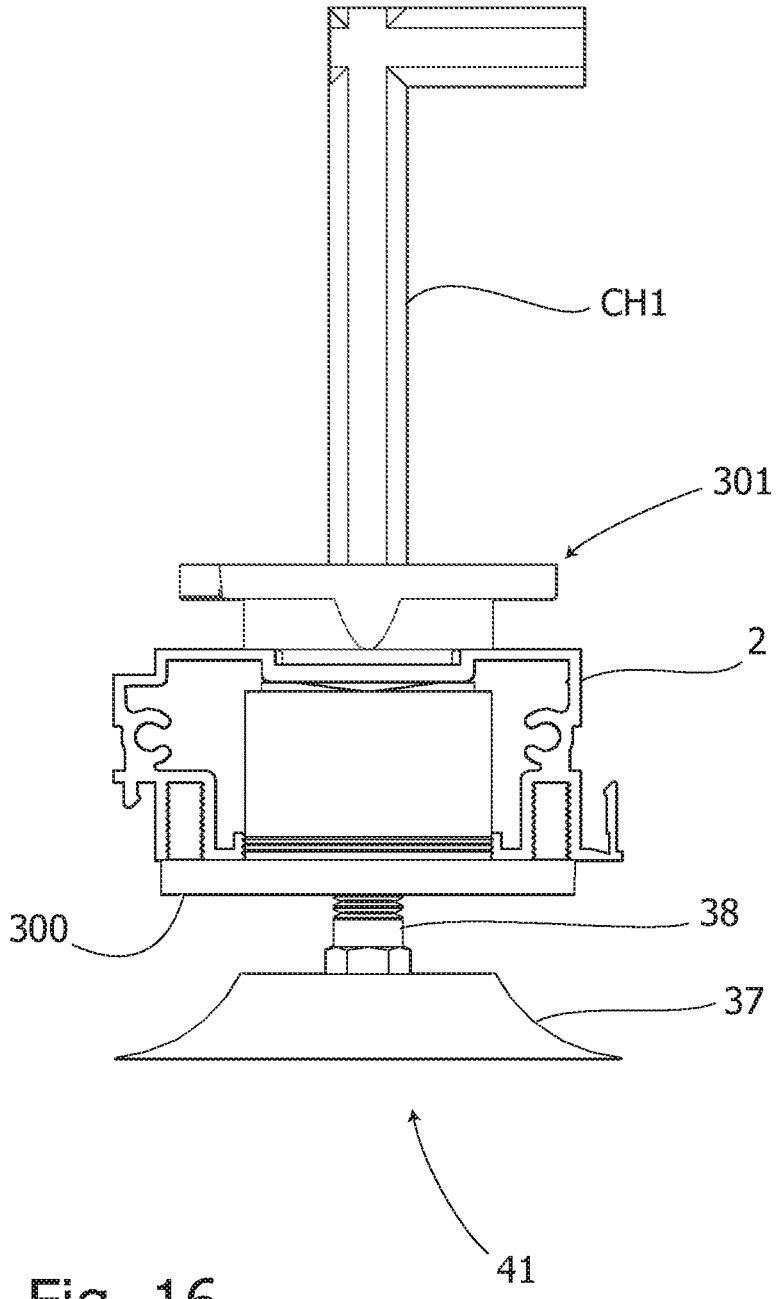
FIG. 16 is a view of the section and clip in FIG. 14 complete with leveling element in a contracted position and with a first hexagonal male key for rotating the clip head.
Figure 17:
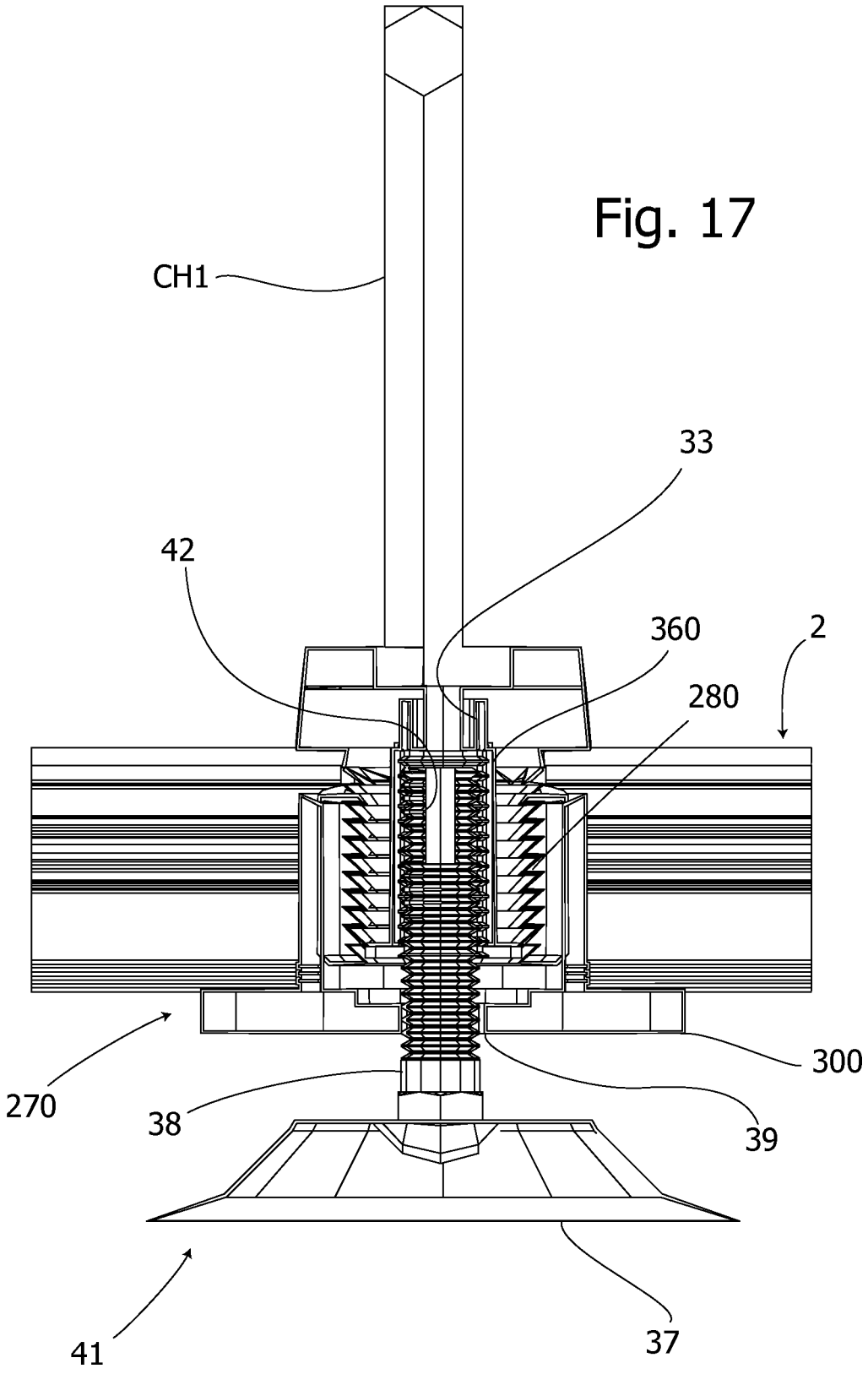
FIG. 17 is a central cross-section of the section and clip in FIG. 16 rotated by 90°.

In the operation of the clip 301 for locking the slats 4 as shown in FIGS. 16 and 17, a hexagonal male key CH1 is used that engages the hexagonal seat 33 already shown in FIG. 12. Thus, the rotation of the head is obtained 250 of the clip 301 for engaging the lateral groove 40 of a slat 4.

Figure 18:
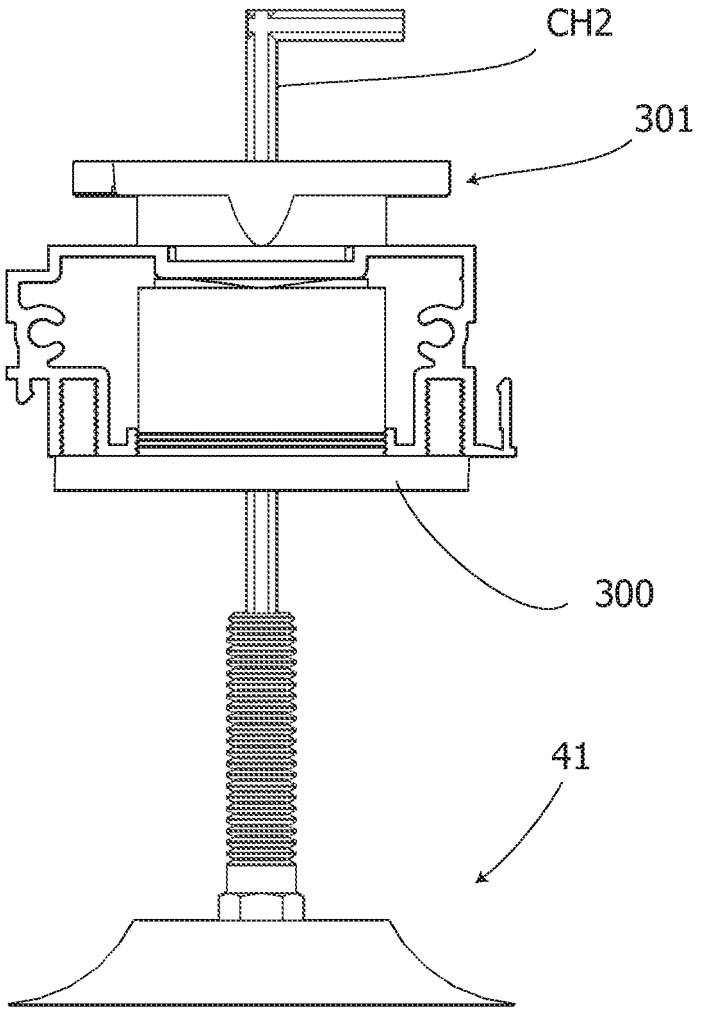
FIG. 18 is a view of the section and clip in FIG. 15 complete with an extended positioning element and a second hexagonal male key for rotating the leveling element.
Figure 19:
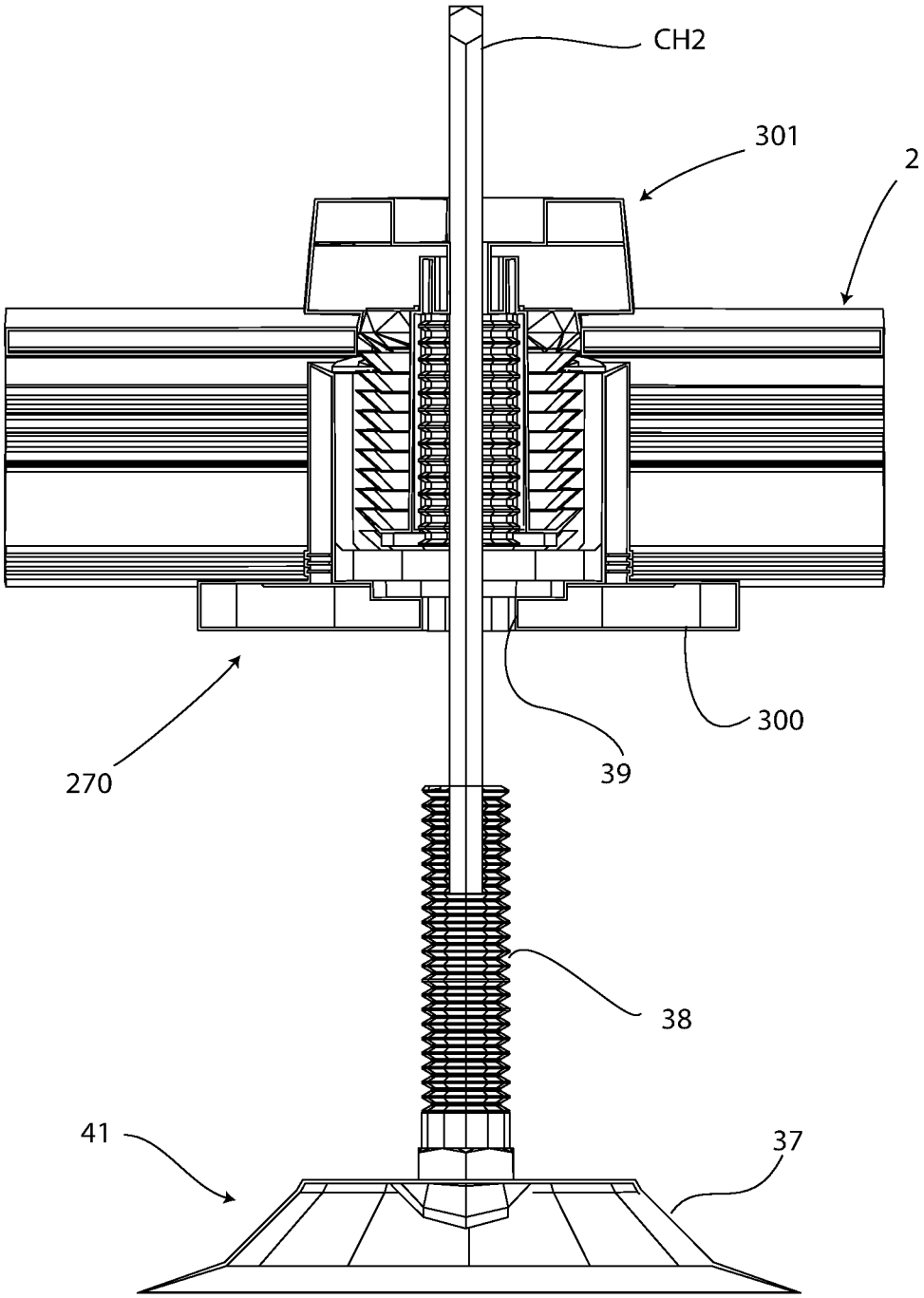
FIG. 19 is a central cross-sectional view of the section and clip in FIG. 18 rotated by 90°.

Instead, in the operation of the clip 301 for adjusting the coating structure level as shown in FIGS. 18 and 19, the hexagonal male key CH2 is used that engages the lowered hexagonal upper seat 42 shown in FIG. 17. In this way, the threaded stem 38 of the foot 37 is rotated, and therefore the raising and lowering of the latter according to the need for adjusting the level of the coating structure according to the present invention is achieved. Such an adjustment can also be made with the installed coating structure.

The invention claimed is:

1. A leveling coating structure (1) with quick installation and removal comprising:

a plurality of parallel sections (2) forming a base frame with its bottom on a supporting plane (V), each section (2) being provided with a multiplicity of through holes (6);

a multiplicity of clamps or clips (3; 301), each clip (3; 301) having a head (25; 250) with a stem (26; 260) and a bushing (27; 270) with inserts (28; 280), the stem (26; 260), which is orthogonal to the head (25; 250), being inserted in a through hole (6) of the section (2) of the base frame and rotatably retained by inserts (28; 280) in the bushing (27; 270) which is in abutment with the bottom of the base frame opposite to the head (25; 250) of the clip (3; 301); and a succession of slats (4) arranged on the parallel sections (2) of the base frame at right angles thereto, to form a coating, each of the slats (4) having opposite lateral grooves (40) which the head (25; 250) of the clip (3; 301) engages;

each section (2) being made of an alloy with a C-shaped cross-section having a core (5) for supporting the slats (4) in which the multiplicity of through holes (6) are formed, and wings (7, 8) mutually spaced apart for the insertion of the bushings (27; 270) between them, wherein the wings (7, 8) end at the bottom with U-inverted supporting feet (14, 15), a supporting foot (14) extending with a portion (16) perpendicular to the inside of the section (2) and with an L-shaped angular portion (17) towards the outside of the section (2), the other supporting foot (15) extending with a first portion (18) perpendicular to the inside of the section (2) and with a second portion (19) perpendicular to the outside prosecuting in a third portion (20) perpendicular upward, to allow the side by side interlock of a section (2) with another.

2. The structure according to claim 1, wherein each clip (3; 301) is retained by the section (2) with the head (25; 250) in abutment with the core (5) for supporting the slats (4) and the bushing (27; 270) in abutment with free ends of the wings (7, 8).

3. The structure according to claim 1, wherein the core (5) of the section (2) has a swallowed central portion (9) in which the through holes (6) are formed.

4. The structure according to claim 1, wherein the wings (7, 8) of the section (2) have facing C-shaped recesses (10, 11) for application to the section (2) of an end plug (13) by means of screws (12) inserted in such C-shaped recesses (10, 11).

5. The structure according to claim 1, wherein a Z-shaped abutment element (21) has a lower portion (22) for fixing with screws on the outer surface of the core (5) of the section (2) and an upper portion (24) adapted to be inserted in the side groove (40) of a slat (4) for retaining a terminal slat of the coating.

6. The structure according to claim 1, wherein the head (25; 250) of the clip (3; 301) is prismatic with a rectangular plan that is beveled in opposite vertices (31) to allow a rotation of the head (25; 250) of the clip (3; 301) of only 90 degrees in the engagement with the lateral groove (40) of the slat (4).

7. The structure according to claim 6, wherein the head (25; 250) of the clip (3; 301) is provided with a downwards facing projection (34) showing its position.

8. The structure according to claim 1, in which the stem (26) of the head (25) of the clip (3) is pierced with a central hole (35) in which a stud (36) projecting upward integrally with the bushing (27) is inserted.

9. The structure according to claim 1, wherein the head (25; 250) of the clip (3; 301) is provided with a first hexagonal hole (33) for engagement with a first hexagonal male key (CH1) for the rotation of the head (25;

250) of the clip (3; 301).

10. The structure according to claim 1, wherein the bushing (270) of the clip (301) houses an upward projecting pin (360), that is drilled and internally threaded, and the base (300) of the bushing (270) is perforated with a hole (39) for the passage of a threaded pin (38) combined with a foot (37) and adapted to engage said projecting pin (360).

11. The structure according to claim 10, wherein said threaded pin (38) with a foot (37) has a second hexagonal hole (42) for engagement with a second hexagonal male key (CH2) for adjusting the height of the base frame with respect to the foot (37).

* * * * *